US007775520B2

(12) United States Patent
Matsudaira et al.

(10) Patent No.: US 7,775,520 B2
(45) Date of Patent: Aug. 17, 2010

(54) PAPER SHEET CONVEYANCE APPARATUS AND IMAGE FORMING APPARATUS

(75) Inventors: Tadashi Matsudaira, Hachioji (JP); Masaaki Goto, Hachioji (JP); Hiroshi Oyama, Hino (JP); Masayuki Watanabe, Fuchu (JP); Shinpei Kawasaki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 688 days.

(21) Appl. No.: 11/646,020

(22) Filed: Dec. 27, 2006

(65) Prior Publication Data

US 2007/0216087 A1 Sep. 20, 2007

(30) Foreign Application Priority Data

Mar. 15, 2006 (JP) ..... 2006-070407

(51) Int. Cl.
*B65H 7/12* (2006.01)

(52) U.S. Cl. ..... 271/284; 271/96; 271/91; 271/265.04

(58) Field of Classification Search ..... 271/301, 271/284, 265.04, 91, 96
See application file for complete search history.

(56) References Cited

U.S. PATENT DOCUMENTS 2,843,882 A * 7/1958 Lewis et al. ..... 19/240
2,952,457 A * 9/1960 Fliegner ..... 271/12
2,992,822 A * 7/1961 Fraidenburgh ..... 271/260
2,994,528 A * 8/1961 Hull et al. ..... 271/260
3,126,199 A * 3/1964 Rosoff ..... 271/12
3,504,911 A * 4/1970 Silverberg ..... 271/260
3,589,714 A * 6/1971 Staples et al. ..... 271/260
3,773,321 A * 11/1973 Burroughs ..... 271/260
4,462,587 A * 7/1984 Graef et al. ..... 271/263
4,736,942 A * 4/1988 Wiley ..... 271/284
5,163,673 A * 11/1992 Heppenstiel ..... 271/263
5,506,670 A * 4/1996 Hatano ..... 399/82
5,848,785 A * 12/1998 Hardwick et al. ..... 271/11
5,879,505 A * 3/1999 Fujisawa et al. ..... 156/344
6,027,113 A * 2/2000 Reljic ..... 271/260
6,494,446 B1 * 12/2002 Tomiyama et al. ..... 271/91
2005/0276198 A1 * 12/2005 Kokubo ..... 369/53.22

FOREIGN PATENT DOCUMENTS

JP 01261130 A * 10/1989
JP 03293239 A * 12/1991
JP 6-32498 2/1994

* cited by examiner

*Primary Examiner*—Patrick Mackey
*Assistant Examiner*—Howard Sanders
(74) *Attorney, Agent, or Firm*—Cantor Colburn LLP

(57) ABSTRACT

There is described a paper sheet conveyance apparatus, which makes it possible to surely separate the overlapping paper sheets from each other irrespective of a kind of paper. The apparatus includes: a thickness detecting section to detect a thickness of a paper sheet, currently conveyed in the conveyance path; a first suction device to adsorb the conveyance paper sheet currently passing through the first suction device; a second suction device to adsorb the overlap paper sheet currently passing through the second suction device; an overlapping conveyance path that is branched from the conveyance path; and a control section that activates the first suction device and the second suction device so as to separate the conveyance paper sheet from the overlap paper sheet, and to introduce the conveyance paper sheet and the overlap paper sheet into the conveyance path and the overlapping conveyance path, respectively.

29 Claims, 5 Drawing Sheets

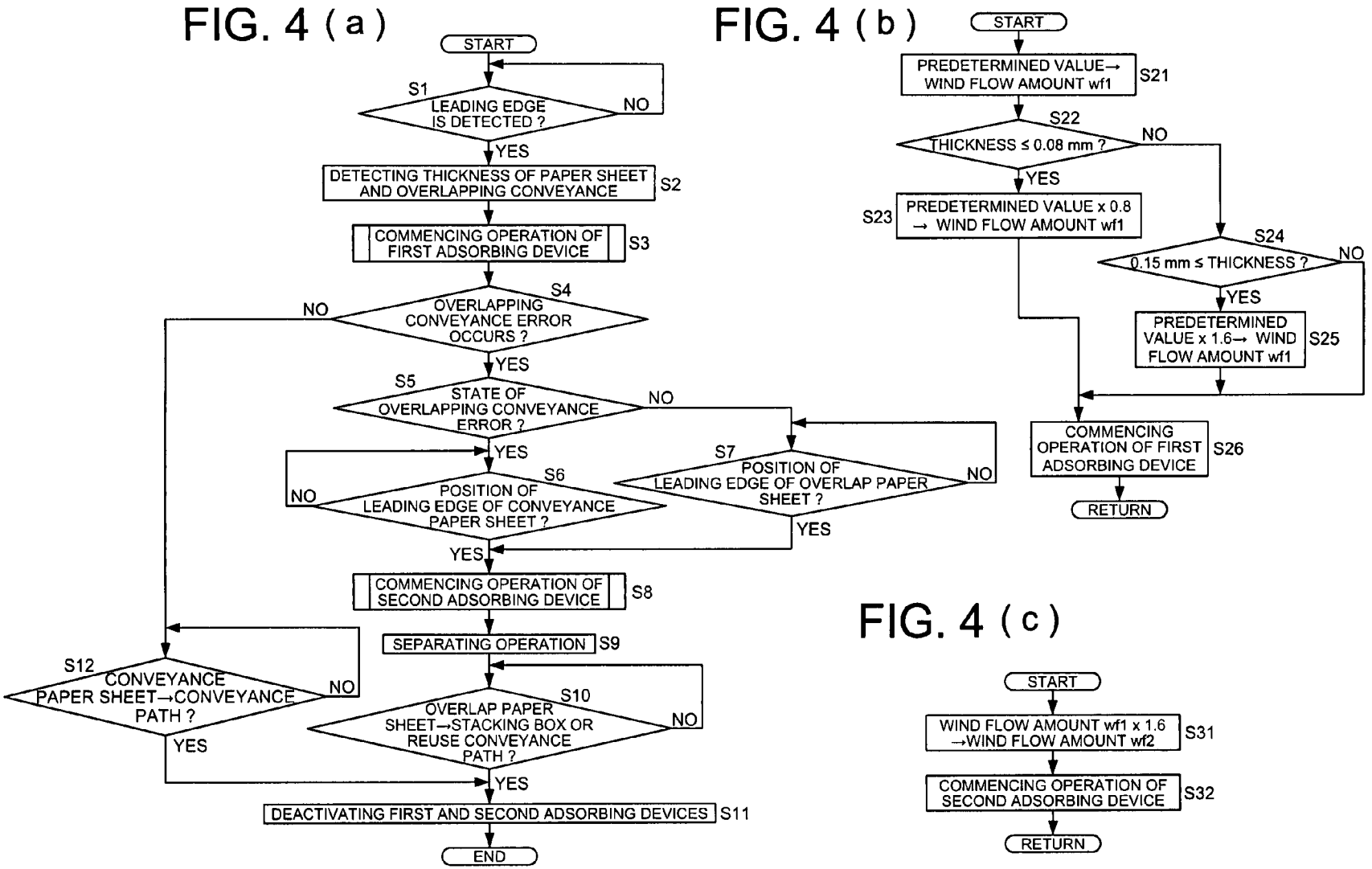
FIG. 4 ( a )
START
S1
LEADING EDGE IS DETECTED ?
NO
YES
S2
DETECTING THICKNESS OF PAPER SHEET AND OVERLAPPING CONVEYANCE
S3
COMMENCING OPERATION OF FIRST ADSORBING DEVICE
S4
OVERLAPPING CONVEYANCE ERROR OCCURS ?
S5
STATE OF OVERLAPPING CONVEYANCE ERROR ?
S6
POSITION OF LEADING EDGE OF CONVEYANCE PAPER SHEET ?
S7
POSITION OF LEADING EDGE OF OVERLAP PAPER SHEET ?
S8
COMMENCING OPERATION OF SECOND ADSORBING DEVICE
S9
SEPARATING OPERATION
S10
OVERLAP PAPER SHEET→STACKING BOX OR REUSE CONVEYANCE PATH ?
S11
DEACTIVATING FIRST AND SECOND ADSORBING DEVICES
END
S12
CONVEYANCE PAPER SHEET→CONVEYANCE PATH ?
FIG. 4 ( b )
START
S21
PREDETERMINED VALUE→ WIND FLOW AMOUNT wf1
S22
THICKNESS ≤ 0.08 mm ?
S23
PREDETERMINED VALUE x 0.8 → WIND FLOW AMOUNT wf1
S24
0.15 mm ≤ THICKNESS ?
S25
PREDETERMINED VALUE x 1.6→ WIND FLOW AMOUNT wf1
S26
COMMENCING OPERATION OF FIRST ADSORBING DEVICE
RETURN
FIG. 4 ( c )
START
S31
WIND FLOW AMOUNT wf1 x 1.6 →WIND FLOW AMOUNT wf2
S32
COMMENCING OPERATION OF SECOND ADSORBING DEVICE
RETURN

PAPER SHEET CONVEYANCE APPARATUS AND IMAGE FORMING APPARATUS

This application is based on Japanese Patent Application No. 2006-070407 filed on Mar. 15, 2006 in Japanese Patent Office, the entire content of which is hereby incorporated by reference.

BACKGROUND OF THE INVENTION

The present invention relates to an image forming apparatus, such as a copier, a facsimile, a printer, etc., and a post processing apparatus, which is directly or indirectly coupled to the image forming apparatus, and specifically relates to a paper sheet conveyance apparatus, which separates an overlap paper sheet from a regular paper sheet to be conveyed, when an overlapping conveyance error occurs during a conveying operation of the paper sheets accommodated in the apparatus.

Conventionally, as the abovementioned kind of paper sheet conveyance apparatus, which separates the overlap paper sheet from the regular paper sheet to convey it, there has been well-known a paper sheet conveyance apparatus, which is provided with an electrostatic charge generating device or a suction fan, serving as an adsorption devise, disposed in the conveyance path so as to prevent the overlapping conveyance error (for instance, set forth in the Patent Document 1, namely, Tokkaihei 6-32498, Japanese Non-Examined Patent Publication). Referring to the drawing, this conventional apparatus will be detailed in the following.

FIG. 7 shows a schematic diagram of a rough configuration of a conventional separating conveyance apparatus. Referring to FIG. 7, the conventional separating conveyance apparatus will be detailed in the following. The paper sheets 2 are accommodated in the paper sheet feeding section 1, so that the paper sheets 2 are picked up one by one by the paper sheet feeding roller 3, and separated for every paper sheet by means of the separation nail 4 so as to feed a single paper sheet one by one. Further, the upper guide plates 11*a*, 11*b*, and the lower guide plates 15*a*, 15*b* are disposed between the pair of conveyance rollers 5 and the pair of registration rollers 7, so as to form the conveyance path 17. The upper guide plates 11*a*, 11*b* are divided into the upstream section 11*a* and the downstream section 11*b*, so that the electrostatic charge generating device 12 can be disposed between the upstream section 11*a* and the downstream section 11*b*, so as to exert the electrostatic force onto the paper sheet conveyed through the conveyance path 17. The area located below the electrostatic charge generating device 12 and between the lower guide plates 15*a*, 15*b* is opened, so as to form the overlap paper sheet conveying path 18, which is extended toward the lower side. The paper sheet 2 is conveyed by the pair of conveyance rollers 5 including the two rollers 5*a* and 5*b* disposed in front of the paper sheet feeding section 1. The paper sheet 2 conveyed by the pair of conveyance rollers 5 is guided by the upper guide plate 11*a* and the lower guide plate 15*a*. When the paper sheet 2 arrives at a position in the vicinity of the electrostatic charge generating device 12, the electrostatic charge generating device 12 is turned ON, based on the paper sheet feeding command. When the overlapping conveyance error of the paper sheet 2 occurs as shown in FIG. 7, the regular paper sheet 19*a* to be conveyed regularly is adsorbed by the electrostatic force generated by the electrostatic charge generating device 12. On the other hand, associating with the action for adsorbing the regular paper sheet 19*a* toward the electrostatic charge generating device 12, the leading edge portion of the overlap paper sheet 19*b* is separated from the regular paper sheet 19*a* by the gravity of the overlap paper sheet 19*b*. The electrostatic force generated by the electrostatic charge generating device 12 is set at a weak force to such an extent that the electrostatic force is barely stronger than the gravity force, and therefore, hardly impedes the conveying operation to be conducted by the pair of conveyance rollers 5 for conveying the regular paper sheet 19*a*. As a result, associating with the conveying action conducted by the pair of conveyance rollers 5, the regular paper sheet 19*a* to be conveyed regularly is guided by the upper guide plate 11*b* and the lower guide plate 15*b* so as to pass through the conveyance path 17, and arrives at the pair of registration rollers 7. Then, the regular paper sheet 19*a* is conveyed to the image forming section by the pair of registration rollers 7, in order to apply a certain image forming operation, such as a copying operation of the original document, etc., to the regular paper sheet 19*a*. On the other hand, the overlap paper sheet 19*b* passes through the overlapping conveyance path 18, and is detected by the overlap paper sheet detecting sensor 10, and passes through the pair of conveyance rollers 14, in order to stack it onto the overlap paper sheet stacking tray 16. Incidentally, in the example mentioned in the above, although the electrostatic charge generating device 12 is employed for adsorbing the overlap paper sheet 19*b*, the suction fan 13 is also applicable for this purpose, instead of the electrostatic charge generating device 12.

As mentioned in the above, according to the separating conveyance apparatus set forth in the Patent Document 1 (namely, Tokkaihei 6-32498, Japanese Non-Examined Patent Publication), the paper sheet separating action is achieved by conveying the necessary paper sheet while adsorbing it, and on the other hand, dropping the overlap paper sheet by using the gravity force caused by its own weight. However, the dropping action by the gravity force caused by its own weight cannot be expected with respect to overlapping paper sheets caused by the frictional electrification, a reuse paper sheet, a thick paper sheet, or the like, and sometimes, such the overlap paper sheet would be conveyed into the regular conveyance path.

In addition, since the abovementioned separating method utilizes the action of the gravity, the application of the method is limited to only a horizontal conveyance structure.

SUMMARY OF THE INVENTION

To overcome the abovementioned drawbacks in conventional paper sheet conveyance apparatus, it is an object of the present invention to provide a paper sheet conveyance apparatus, which makes it possible to surely separate the overlapping paper sheets from each other irrespective of a kind of paper, so as to continuously conduct the printing operation without stopping the apparatus even when the overlapping conveyance error occurs, and accordingly, also makes it possible to shorten the time period required for the printing operation, resulting in an improvement of the availability factor of the image forming apparatus, and further, the conveyance posture of which is not restricted to a specific direction.

Accordingly, to overcome the cited shortcomings, the abovementioned object of the present invention can be attained by the paper sheet conveyance apparatus and the image forming apparatus, described as follow.

(1) A paper sheet conveyance apparatus for conveying a paper sheet, picked up from a paper sheet feeding section, through a conveyance path, comprising: a thickness detecting section to detect a thickness of either a single paper sheet or overlapping paper sheets, which includes a conveyance paper sheet and an overlap paper sheet, currently conveyed in the conveyance path; a first suction device, disposed at a first position within the conveyance path, to adsorb the conveyance paper sheet currently passing through the first suction device; a second suction device, disposed at a second position substantially opposing to the first position within the conveyance path, to adsorb the overlap paper sheet currently passing through the second suction device; an overlapping conveyance path that is branched from the conveyance path; and a control section to conduct controlling operations in such a manner that, when the overlapping paper sheets are conveyed into the conveyance path from the paper sheet feeding section, the first suction device and the second suction device are activated to separate the conveyance paper sheet from the overlap paper sheet, so as to introduce the conveyance paper sheet and the overlap paper sheet into the conveyance path and the overlapping conveyance path, respectively.

(2) An image forming apparatus, comprising: an image forming section to form an image onto a paper sheet; and a paper sheet conveyance section to convey the paper sheet, picked up from a paper sheet feeding section, to the image forming section through a conveyance path; wherein the paper sheet conveyance section includes: a thickness detecting section to detect a thickness of either a single paper sheet or overlapping paper sheets, which includes a conveyance paper sheet and an overlap paper sheet, currently conveyed in the conveyance path; a first suction device, disposed at a first position within the conveyance path, to adsorb the conveyance paper sheet currently passing through the first suction device; a second suction device, disposed at a second position substantially opposing to the first position within the conveyance path, to adsorb the overlap paper sheet currently passing through the second suction device; an overlapping conveyance path that is branched from the conveyance path; and a control section to conduct controlling operations in such a manner that, when the overlapping paper sheets are conveyed into the conveyance path from the paper sheet feeding section, the first suction device and the second suction device are activated to separate the conveyance paper sheet from the overlap paper sheet, so as to introduce the conveyance paper sheet and the overlap paper sheet into the conveyance path and the overlapping conveyance path, respectively.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 4(*a*), FIG. 4(*b*) and FIG. 4(*c*) show flowcharts of processing procedures of a first suction device and a second suction device, both of which are controlled by a control section embodied in the present invention;

DETAILED DESCRIPTION OF THE PREFERRED EMBODIMENT

Figure 1:
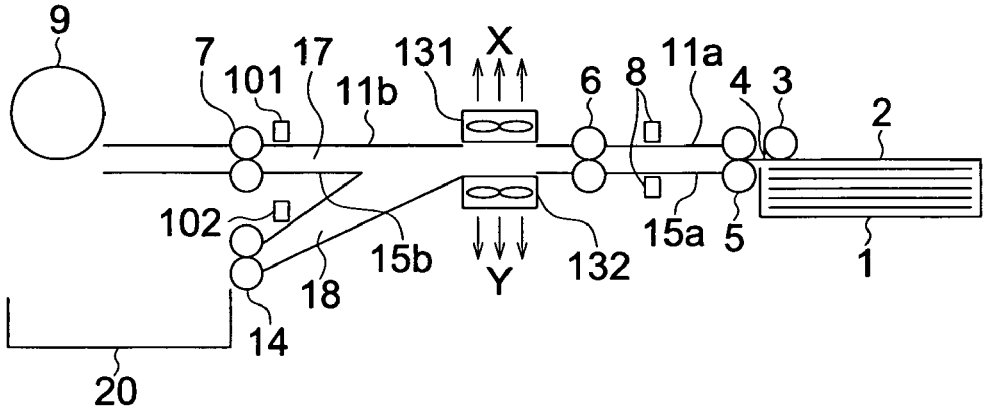
FIG. 1 shows an example of a rough configuration of a paper sheet conveyance apparatus embodied in the present invention.

Referring to the drawings, the preferred embodiment of the present invention will be detailed in the following.

FIG. 1 shows an example of a rough configuration of a paper sheet conveyance apparatus embodied in the present invention.

Referring to FIG. 1, the paper sheet conveyance apparatus embodied in the present invention will be detailed in the following. Paper sheets 2 are accommodated in a paper sheet feeding section 1, so that the paper sheets 2 are picked up one by one by a paper sheet feeding roller 3, and separated for every paper sheet by employing a separation nail 4 so as to feed a single paper sheet 2*a* one by one. Further, a thickness detecting sensor 8, serving as a thickness detecting section, is disposed at a position located between a pair of conveyance rollers 5 and a pair of conveyance rollers 6. The thickness detecting sensor 8 includes ultrasound detecting elements so as to detect the thickness of the paper sheet passing through a space between an ultrasound emitting element and a receiving element. Still further, upper guide plates 11*a*, 11*b*, and lower guide plates 15*a*, 15*b* are disposed between the pair of conveyance rollers 5 and a pair of registration rollers 7, so as to form a conveyance path 17. The upper guide plates 11*a*, 11*b* are divided into an upstream guide plate 11*a* and a downstream guide plate 11*b*, so that a first suction device 131 can be disposed between the upstream guide plate 11*a* and the downstream guide plate 11*b*. The lower guide plates 15*a*, 15*b* are also divided into an upstream guide plate 15*a* and a downstream guide plate 15*b*, so that a second suction device 132 can be disposed between the upstream guide plate 15*a* and the downstream guide plate 15*b*. In addition, an overlapping conveyance path 18, through which an overlap paper sheet separated from a regular paper sheet is conveyed, is formed therefrom, in such a manner that it extends toward the lower side. In the example shown in FIG. 1, the downstream end portion of the upstream guide plate 15*a* and the upstream end portion of the downstream guide plate 15*b*, both of which respectively form the upstream section and the downstream section of the lower guide plates 15*a*, 15*b*, are bended towards the lower side, so that the extended potions constitute the overlapping conveyance path 18 through which an overlap paper sheet separated is conveyed. An overlap paper sheet detecting sensor 102 is disposed at a position located in a mid-course of the overlapping conveyance path 18, and a stacking box 20 is disposed at the end portion of the overlapping conveyance path 18. In the example shown in FIG. 1, a pair of ejecting rollers 14 is also disposed at a position in the vicinity of the end portion of the overlapping conveyance path 18. On the other hand, the conveyance path 17 is extended toward the downstream side from the first suction device 131, so that a paper sheet conveyance detecting sensor 101 and the pair of registration rollers 7 are disposed on the conveyance path 17, and the single paper sheet 2*a* can be conveyed to a photoreceptor drum 9.

Next, the separating operation of the overlapping paper sheets, conducted by a control section and embodied in the present invention, will be detailed in the following.

Figure 2:
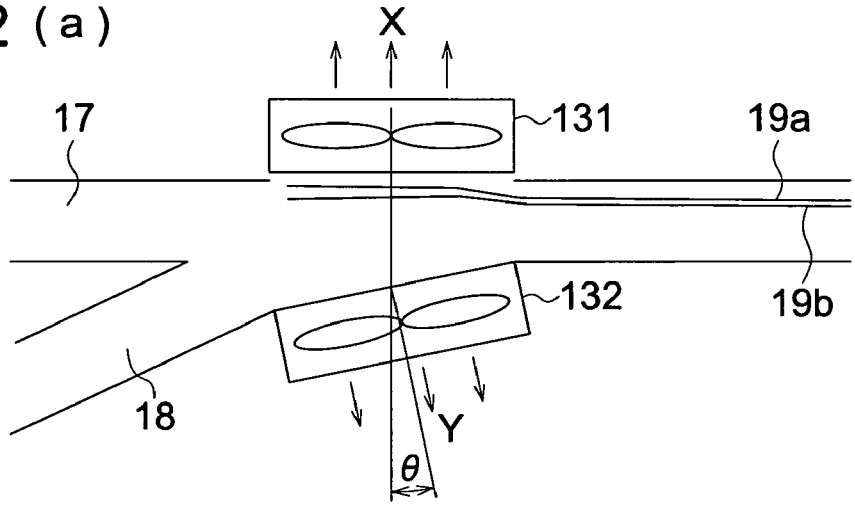
FIG. 2(*a*) and FIG. 2(*b*) show explanatory schematic diagrams for explaining a separating operation of overlapping paper sheets, when a thickness detecting sensor detects an overlapping conveyance at a portion being apart from a leading edge of a paper sheet by a distance smaller than 20 mm.
Figure 2:
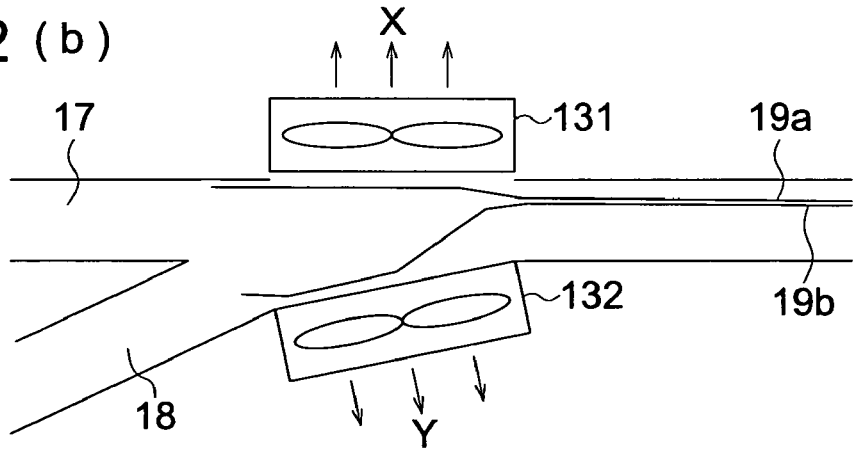

FIG. 2(*a*) and FIG. 2(*b*) show explanatory schematic diagrams for explaining the separating operation of the overlapping paper sheets, when the thickness detecting sensor 8 detects an overlapping conveyance at a portion being apart from the leading edge of the paper sheet by a distance smaller than 20 mm.

The paper sheets 2 fed from the paper sheet feeding section 1 are conveyed by the pair of conveyance rollers 5. Then, the thickness detecting sensor 8 detects whether overlapping paper sheets are conveyed or the single paper sheet 2*a* is conveyed with respect to the paper sheet(s) 2 currently conveyed by the pair of conveyance rollers 5. Further, when detecting that the overlapping paper sheets are conveyed, the thickness detecting sensor 8 also detects a length of a portion at which a conveyance paper sheet 19*a* and an overlap paper sheet 19*b* overlap with each other. For instance, after a certain time period has passed since the leading edge of the paper sheet passed through the thickness detecting sensor 8, when the a conveyance paper sheet 19*a* passes through the thickness detecting sensor 8 in a state of overlapping with the overlap paper sheet 19*b*, it is possible to derive (detect) the length of the overlapping portion of the conveyance paper sheet 19*a* and the overlap paper sheet 19*b*, from the certain time period and a conveying velocity of the paper sheets 2. When the leading edge of the paper sheet (conveyance paper sheet 19*a*) passes through the thickness detecting sensor 8, the first suction device 131 is turned ON, so that, for instance, a fan generates the wind flowing in a direction indicated by the arrow X. The paper sheet passing through the thickness detecting sensor 8 is further conveyed to the position of the first suction device 131 and the second suction device 132. As shown in FIG. 2(*a*), when the conveyance paper sheet 19*a*, among the overlapping paper sheets, is conveyed to such a position that the conveyance paper sheet 19*a* closes the suction inlet of the first suction device 131, the second suction device 132 is turned ON, so that a fan generates the wind flowing in a direction indicated by the arrow Y. As a result, the overlap paper sheet 19*b*, among the overlapping paper sheets, is adsorbed toward the lower side as shown in the drawing, and the separating action of the overlap paper sheet 19*b* begins as shown in FIG. 2(*b*). Then, the paper sheets are further conveyed so that the conveyance paper sheet 19*a* is introduced into the conveyance path 17, while the overlap paper sheet 19*b* is introduced into the overlapping conveyance path 18.

Each of the first suction device 131 and the second suction device 132 is constituted by a single fan or a plurality of fans, depending on the required suction ability.

Returning to FIG. 1, the paper sheet conveyance detecting sensor 101 detects the leading edge of the conveyance paper sheet 19*a*, and the pair of registration rollers 7 corrects its registration, so that the conveyance paper sheet 19*a* is conveyed to the photoreceptor drum 9, in order to form an image on it.

On the other hand, the overlap paper sheet 19*b* is conveyed through the overlapping conveyance path 18 to the stacking box 20 by the pair of ejecting rollers 14, so as to stack the overlap paper sheet 19*b* into the stacking box 20. Incidentally, the overlap paper sheet 19*b* stacked into the stacking box 20 can be reused as the paper sheets 2 by stacking them again onto the paper sheet feeding section 1.

Although the paper sheet is conveyed in the horizontal direction in the paper sheet conveyance apparatus exemplified in the above, since not only the gravity force caused by own weight but also the suction force generated by the fan are employed for separating the overlap paper sheet 19*b* from the conveyance paper sheet 19*a*, the conveying direction of the paper sheet can be set at any direction, for instance, a vertical direction.

Further, although the operation commencing time of the first suction device 131 is set at the time when the leading edge of the conveyance paper sheet 19*a* passes through the thickness detecting sensor 8 in the example mentioned in the above, it is also applicable that the first suction device 131 is always turned ON so as to keep the suction force active during the operating time of the apparatus.

As shown in FIGS. 2(*a*) and 2(*b*), the second suction device 132 is mounted in such a manner that the second suction device 132 is inclined relative to the first suction device 131. By setting an inclination angle θ, between the suction direction of the second suction device 132 and that of the first suction device 131 in the upstream direction of the conveyance paper sheet 19*a*, at a value in a range of 10°-40°, it becomes possible not only to reduce the jam occurring frequency of the overlap paper sheet 19*b* separated, but also to stably introduce it into the overlapping conveyance path 18, though its effect varies depending on the mounting angle between the overlapping conveyance path 18 and the conveyance path 17.

Figure 3:
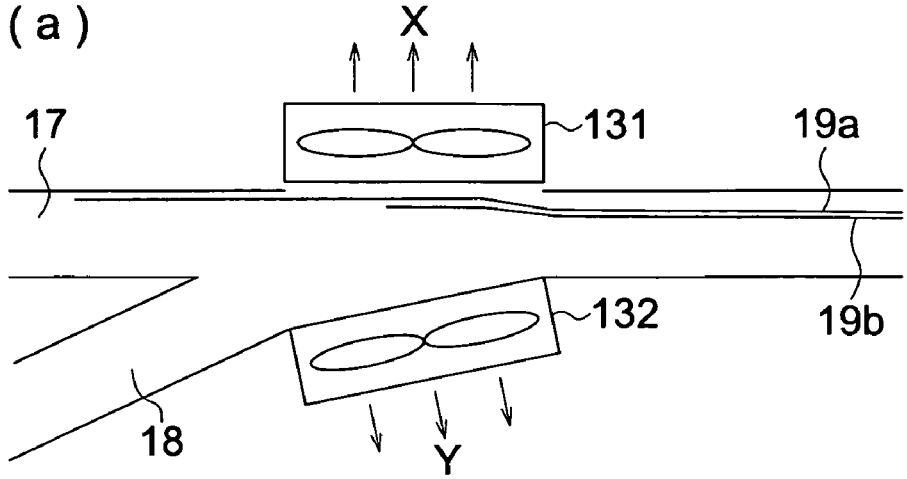
FIG. 3(*a*) and FIG. 3(*b*) show explanatory schematic diagrams for explaining a separating operation of overlapping paper sheets, when a thickness detecting sensor detects an overlapping conveyance at a portion being apart from a leading edge of a paper sheet by a distance equal to or greater than 20 mm.
Figure 3:
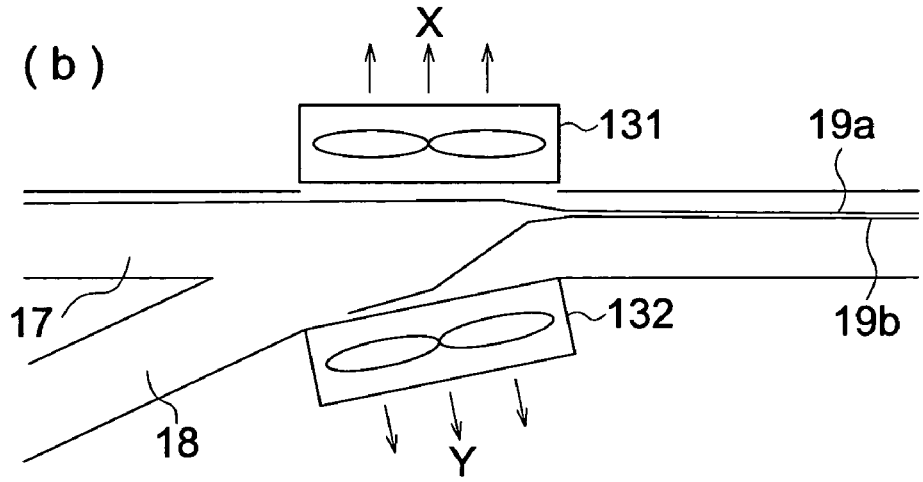

FIGS. 3(*a*) and 3(*b*) show a paper sheet separating operation when the thickness detecting sensor 8 detects the overlapping conveyance error at a position being apart from the leading edge of the paper sheet by 20 mm or more.

The paper sheets 2 fed from the paper sheet feeding section 1 are conveyed by the pair of conveyance rollers 5. Then, the thickness detecting sensor 8 detects whether overlapping paper sheets are conveyed or the single paper sheet 2*a* is conveyed with respect to the paper sheet(s) 2 currently conveyed by the pair of conveyance rollers 5. Further, when detecting that the overlapping paper sheets are conveyed, the thickness detecting sensor 8 also detects a length of a portion at which a conveyance paper sheet 19*a* and an overlap paper sheet 19*b* overlap with each other. When the leading edge of the paper sheet (conveyance paper sheet 19*a*) passes through the thickness detecting sensor 8, the first suction device 131 is turned ON, so that a fan generates the wind flowing in a direction indicated by the arrow X. The paper sheet passing through the thickness detecting sensor 8 is further conveyed to the position of the first suction device 131 and the second suction device 132. As shown in FIG. 3(*a*), when the overlap paper sheet 19*b*, among the overlapping paper sheets, is conveyed to the center of the second suction device 132, after the conveyance paper sheet 19*a* is conveyed to such a position that the conveyance paper sheet 19*a* closes the suction inlet of the first suction device 131, the second suction device 132 is turned ON, so that a fan generates the wind flowing in a direction indicated by the arrow Y. Incidentally, as mentioned in the foregoing, the conveying distances of the conveyance paper sheet 19*a* and the overlap paper sheet 19*b* are calculated from the elapsed time since the thickness detecting sensor 8 has detected them and the conveying velocity of the paper sheets 2. Due to the wind flow in the direction indicated by the arrow Y, the overlap paper sheet 19*b*, among the overlapping paper sheets, is adsorbed toward the lower side as shown in the drawing, and the separating action of the overlap paper sheet 19*b* begins as shown in FIG. 3(*b*). Then, the paper sheets are further conveyed so that the conveyance paper sheet 19*a* is introduced into the conveyance path 17, while the overlap paper sheet 19*b* is introduced into the overlapping conveyance path 18.

When only a single paper sheet is fed from the paper sheet feeding section 1, the thickness detecting sensor 8 detects that the single paper sheet is currently conveyed, and accordingly, only the first suction device 131 is turned ON so as to absorb the paper sheet upward. The paper sheet is introduced into the conveyance path 17 while being absorbed by the first suction device 131. In other words, when only a single paper sheet is conveyed, the second suction device 132 is deactivated, so as not to conduct the adsorbing action.

FIGS. 4(*a*), 4(*b*) and 4(*c*) show flowcharts of processing procedures of the first suction device 131 and the second suction device 132, which are controlled by a control section embodied in the present invention.

FIG. 4(*a*) shows a main routine of the processing procedure.

Figure 5:
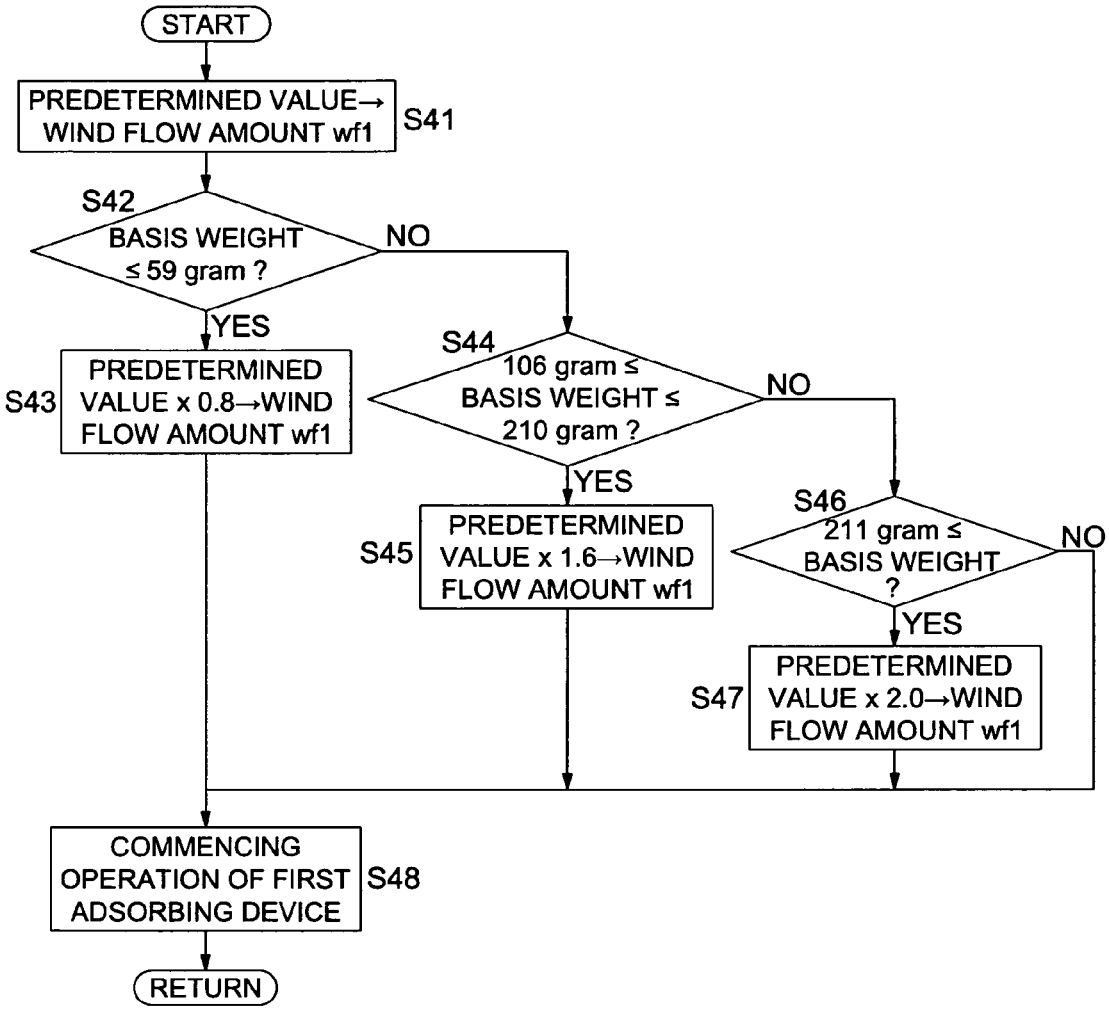
FIG. 5 shows a subroutine flowchart for commencing an operation of a first suction device in which an amount of wind flow is controlled on the basis of a basis weight of a paper sheet.

The main routine of the processing procedure, to be conducted by the control section, includes the steps of: detecting a leading edge of the paper sheet by employing the thickness detecting sensor in Step S1; entering into Step S2 when the thickness detecting sensor detects the leading edge of the paper sheet (Step S1, YES); waiting at Step S1 when the thickness detecting sensor does not detect the leading edge of the paper sheet (Step S1, NO); detecting a thickness and an overlapping conveyance error of the paper sheet by employing the thickness detecting sensor in Step S2; jumping to the subroutine for commencing the operation to be conducted by the first suction device in Step S3, namely, jumping to Step S21 shown in FIG. 4(*b*) when controlling an amount of wind flow, based on the thickness of the paper sheet, or jumping to Step S41 shown in FIG. 5 when controlling an amount of wind flow, based on the basis weight of the paper sheet; determining whether or not the overlapping conveyance error occurs in Step S4; proceeding to Step S5, when determining that the overlapping conveyance error occurs (Step S4, YES); proceeding to Step S12, when determining that the overlapping conveyance error does not occur, namely, only the single paper sheet is currently conveyed (Step S4, NO); confirming a state of the overlapping conveyance error in Step S5, namely, proceeding to Step S6 when a deviation amount between the conveyance paper sheet and the overlap paper sheet 19*b* is smaller than 20 mm (Step S5, YES), or proceeding to Step S7 when a deviation amount between the conveyance paper sheet and the overlap paper sheet 19*b* is equal to or greater than 20 mm (Step S5, NO); determining whether or not the leading edge of the paper sheet passes through the first suction device in Step S6, in other words, whether or not the conveyance paper sheet is conveyed to such a position that it covers all over the first suction device, namely, proceeding to Step S8 when determining that the leading edge of the paper sheet passes through the first suction device (Step S6, YES), or waiting at Step S6 when determining that the leading edge of the paper sheet does not pass through the first suction device (Step S6, NO); determining whether or not the leading edge of the overlap paper sheet passes through a center of the second suction device in Step S7, namely, proceeding to Step S8 when determining that the leading edge of the overlap paper sheet passes through the center of the second suction device (Step S7, YES), or waiting at Step S7 when determining that the leading edge of the overlap paper sheet does not pass through the center of the second suction device (Step S7, NO); jumping to Step S31 in the subroutine of commencing the operation of the second suction device shown in FIG. 4(*c*) in Step S8; activating the first suction device and the second suction device to implement the separating operation of the overlap paper sheets by the absorbing actions of them in Step S9; determining whether or not the overlap paper sheet separated is conveyed to a transferring position of a toner image through the conveyance path and whether or not the overlap paper sheet is conveyed to the stacking box or a reuse conveyance path 21 detailed later in Step S10, where the paper sheet conveyance detecting sensor 101 detects a trailing edge of the conveyance paper sheet while the overlap paper sheet detecting sensor 102 detects a trailing edge of the overlap paper sheet in order to achieve the determining operation in Step S10; proceeding to Step S11 when both trailing edges of the conveyance paper sheet and the overlap paper sheet are detected (Step S10, YES), or waiting at Step S10 when any one of the trailing edges of the conveyance paper sheet and the overlap paper sheet is not detected (Step S10, NO); deactivating the operations of the first and second suction devices in Step S11; determining whether or not the conveyance paper sheet is conveyed to the transferring position of the toner image through the conveyance path by detecting the trailing edge of the conveyance paper sheet in Step S12; proceeding to Step S11 when determining that the conveyance paper sheet is conveyed to the transferring position (Step S12, YES), or waiting at Step S12 when determining that the conveyance paper sheet is not conveyed to the transferring position (Step S12, NO); and deactivating the operation of the first suction device in Step S11 when determining that the conveyance paper sheet is conveyed to the transferring position (Step S12, YES).

As mentioned in the above, by commencing the operation of the second suction device at the time when the conveyance paper sheet totally closes the first suction device and passes through the center of the second suction device, it becomes possible to securely conduct the operation for separating the overlap paper sheets from each other.

FIG. 4(*b*) shows a subroutine flowchart for commencing the operation of the first suction device in which the amount of wind flow is controlled on the basis of the thickness of the paper sheet.

The subroutine flowchart for commencing the operation of the first suction device, shown in FIG. 4(*b*), includes the steps of: storing a predetermined value into a memory area of a wind flow amount wf1 in Step S21, where a wind flow amount wf1 is defined as a memory area for storing a wind flow amount of the first suction device, while the predetermined value indicates the wind flow amount of the first suction device, an optimum value of which is set at a value in a range of 0.3-0.9 $m^3$/minute, for instance, at 0.6 $m^3$/minute; determining whether or not the thickness of the paper sheet is equal to or smaller than 0.08 mm in Step S22, namely, proceeding to Step S23 when determining that the thickness of the paper sheet is equal to or smaller than 0.08 mm (Step S22, YES), or proceeding to Step S24 when determining that the thickness of the paper sheet is greater than 0.08 mm (Step S22, NO); storing a value of 0.8 times of the predetermined value, for instance, $0.6\times0.8=0.48$ $m^3$/minute, into the memory area of the wind flow amount wf1 in Step S23; determining whether or not the thickness of the paper sheet is equal to or greater than 0.15 mm in Step S24, namely, proceeding to Step S25 when determining that the thickness of the paper sheet is equal to or greater than 0.15 mm (Step S24, YES), or proceeding to Step S26 when determining that the thickness of the paper sheet is smaller than 0.15 mm (Step S24, NO); storing a value of 1.6 times of the predetermined value, for instance, $0.6\times1.6=0.96$ $m^3$/minute, into the memory area of the wind flow amount wf1 in Step S25; commencing the operation of the first suction device by employing the wind flow value stored in the memory area of the wind flow amount wf1 in Step S26; and returning to the main routine.

FIG. 4(*c*) shows a subroutine flowchart for commencing the operation of the second suction device.

The subroutine flowchart for commencing the operation of the second suction device, shown in FIG. 4(*c*), includes the steps of: storing a value of 1.6 times of the wind flow amount, stored in the memory area of the wind flow amount wf1, into a memory area of a wind flow amount wf2 in Step S31, where a wind flow amount wf2 is defined as a memory area for storing a wind flow amount of the second suction device, for instance, when the thickness of the paper sheet is equal to or greater than 0.15 mm, since the value of 0.96 $m^3$/minute is stored in the wind flow amount wf1, a value of 0.96×1.6=1.536 $m^3$/minute is stored in the memory area of a wind flow amount wf2; commencing the operation of the second suction device by employing the wind flow value stored in the memory area of the wind flow amount wf2 in Step 32; and returning to the main routine.

As mentioned in the above, by changing the wind flow amount corresponding to the thickness of the paper sheet, it becomes possible to surely conduct the operation for separating the overlap paper sheets from each other.

Table 1 shows results of the experiments for considering the separating effects of the paper sheets, conducted by changing the wind flow amount of the second suction device with respect to the first suction device. The term of "wind flow amount ratio" indicates a value derived by dividing the wind flow amount of the second suction device by that of the first suction device.

TABLE 1

| Wind flow amount ratio | Consideration results of separating effects |
|---|---|
| 0.8 times | Due to inability of separating action conducted by the first suction device, both paper sheets are introduced into the conveyance path. |
| 1.0 times | Due to inability of separating action conducted by the first suction device, both paper sheets are introduced into the conveyance path. |
| 1.2 times | Paper sheets can be separated. Separated paper sheets are conveyed to the conveyance path and the overlapping conveyance path, respectively. |
| 1.5 times | Paper sheets can be separated. Separated paper sheets are conveyed to the conveyance path and the overlapping conveyance path, respectively. |
| 1.8 times | Paper sheets can be separated. Separated paper sheets are conveyed to the conveyance path and the overlapping conveyance path, respectively. |
| 2.0 times | Paper sheets can be separated. Separated paper sheets are conveyed to the conveyance path and the overlapping conveyance path, respectively. |
| 2.5 times | Both paper sheets are introduced into the overlapping conveyance path by the absorbing action of the second suction device. |
| 3.0 times | Both paper sheets are introduced into the overlapping conveyance path by the absorbing action of the second suction device. |

In the results shown in Table 1, some pairs of overlapping paper sheets cannot be separated from each other and are conveyed together at each of the wind flow amount ratios of 0.8 times, 1.0 times, 2.5 times and 3.0 times. However, overlapping paper sheets can be surely separated from each other and are conveyed separately at a value of the wind flow amount ratio in a range of 1.2 times-2.0 times. As mentioned in the foregoing (refer to Step S31), the wind flow amount of the second suction device is set at a value 1.6 times of that of the first suction device in the abovementioned example embodied in the present invention.

According to the present invention, by setting the wind flow amount ratio of the second suction device versus the first suction device at a value in a range of 1.2 times-2.0 times, it becomes possible to surely conduct the operation for separating the overlapping paper sheets from each other.

FIG. 5 shows a subroutine flowchart for commencing the operation of the first suction device in which the amount of wind flow is controlled on the basis of the basis weight of the paper sheet.

The basis weight, corresponding to the paper sheets to be fed from the paper sheet feeding section, is inputted in advance from an operating section (not shown in the drawings) of an image forming apparatus in which the paper conveyance apparatus embodied in the present invention is installed.

The subroutine flowchart for commencing the operation of the first suction device, shown in FIG. 5, includes the steps of: storing a predetermined value into a memory area of a wind flow amount wf1 in Step S41, where a wind flow amount wf1 is defined as a memory area for storing a wind flow amount of the first suction device, while the predetermined value indicates the wind flow amount of the first suction device, an optimum value of which is set at a value in a range of 0.3-0.9 $m^3$/minute, for instance, at 0.6 $m^3$/minute; determining whether or not the basis weight of the paper sheet is equal to or smaller than 59 gram in Step S42, namely, proceeding to Step S43 when determining that the basis weight of the paper sheet is equal to or smaller than 59 gram (Step S42, YES), or proceeding to Step S44 when determining that the basis weight of the paper sheet is equal to or greater than 60 gram (Step S42, NO); storing a value of 0.8 times of the predetermined value, for instance, 0.6×0.8=0.48 $m^3$/minute, into the memory area of the wind flow amount wf1 in Step S43; determining whether or not the basis weight of the paper sheet is in a range of 106-210 gram in Step S44, namely, proceeding to Step S45 when determining that the basis weight of the paper sheet is in a range of 106-210 gram (Step S44, YES), or proceeding to Step S46 when determining that the basis weight of the paper sheet is not in a range of 106-210 gram (Step S44, NO); storing a value of 1.6 times of the predetermined value, for instance, 0.6×1.6=0.96 $m^3$/minute, into the memory area of the wind flow amount wf1 in Step S45; determining whether or not the basis weight of the paper sheet is equal to or greater than 211 gram in Step S42, namely, proceeding to Step S47 when determining that the basis weight of the paper sheet is equal to or greater than 211 gram (Step S46, YES), or proceeding to Step S48 when determining that the basis weight of the paper sheet is equal to or smaller than 210 gram (Step S42, NO); storing a value of 2.0 times of the predetermined value, for instance, 0.6×2.0=1.2 $m^3$/minute, into the memory area of the wind flow amount wf1 in Step S47; commencing the operation of the first suction device by employing the wind flow value stored in the memory area of the wind flow amount wf1 in Step S48; and returning to the main routine.

As mentioned in the above, by changing the wind flow amount of the first suction device, corresponding to the basis weight of the paper sheet, it becomes possible to surely conduct the operation for separating the overlap paper sheets from each other.

Figure 6:
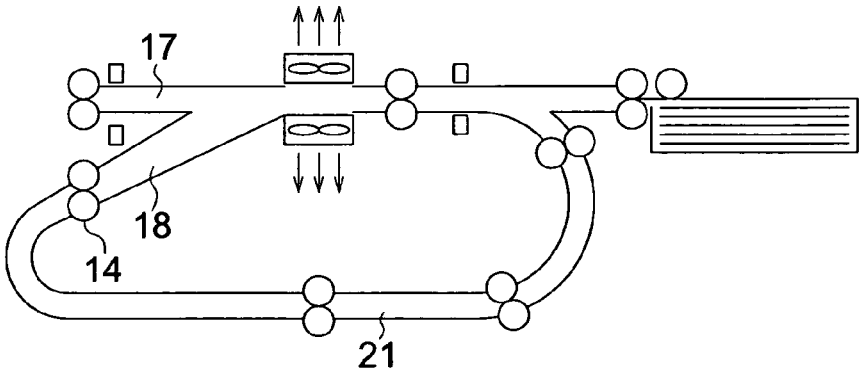
FIG. 6 shows a schematic diagram of a paper sheet conveyance configuration in which an overlap paper sheet, separated from a conveyance paper sheet, is conveyed into a reuse conveyance path through an overlapping conveyance path.
Figure 7:
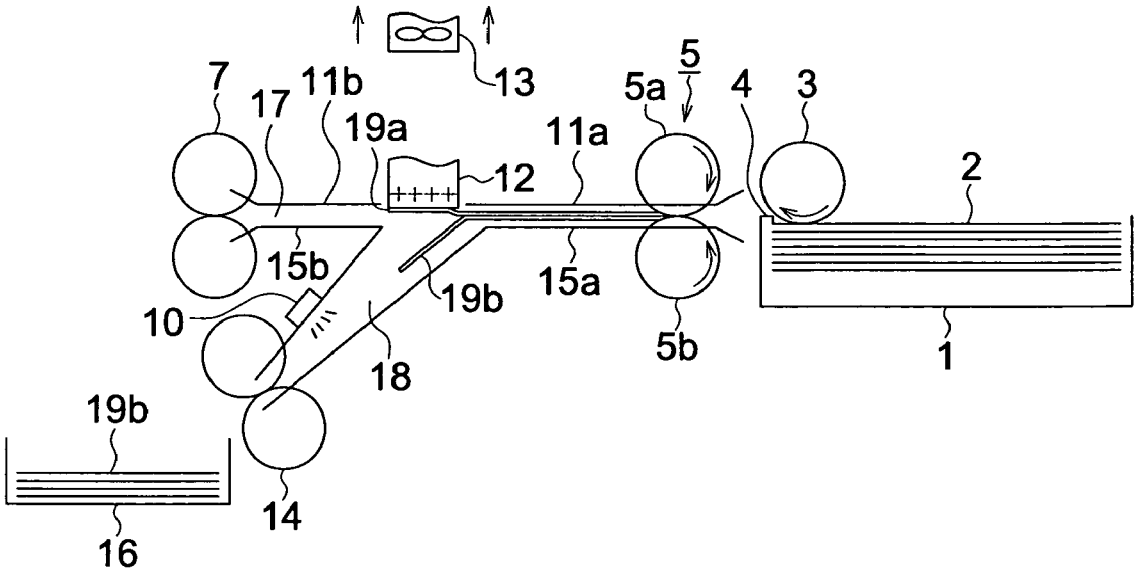
FIG. 7 Prior Art
FIG. 7 shows a schematic diagram of a rough configuration of a conventional separating conveyance apparatus.

FIG. 6 shows a schematic diagram of the paper sheet conveyance configuration in which the overlap paper sheet, separated from the conveyance paper sheet, is conveyed into the reuse conveyance path 21 through the overlapping conveyance path.

In the configuration shown in FIG. 1, the overlap paper sheet, separated from the conveyance paper sheet, is conveyed into the stacking box 20 through the overlapping conveyance path 18. Accordingly, it becomes possible to reuse the overlap paper sheets stacked on the stacking box 20 by taking out the overlap paper sheets from the stacking box 20 and again stacking them onto the paper sheet feeding section 1.

On the other hand, according to the configuration shown in FIG. 6, since the overlap paper sheet, separated from the conveyance paper sheet, is ejected into the reuse conveyance path 21 through the overlapping conveyance path 18 by the pair of ejecting rollers 14 so as to again introduce it into the conveyance path, it becomes possible to automatically reuse the overlap paper sheet without requiring any manual handling.

Incidentally, the paper sheet conveyance apparatus embodied in the present invention can be installed into not only an image forming apparatus, such as a copier, a printer, a facsimile, etc., but also, a post processing apparatus to be coupled to the image forming apparatus directly or indirectly.

Other than the embodiment described in the foregoing, the detailed structures and operations of the disclosed embodiment can be varied by a skilled person without departing from the spirit and scope of the invention.

According to the present invention, since the printing operation can be conducted continuously without stopping the apparatus, even when the overlapping conveyance error occurs, by surely separating the overlapping paper sheets, currently conveyed, from each other, it becomes possible to shorten the time period required for the printing operation, resulting in an improvement of the availability factor of the image forming apparatus. Further, since the separating action can be achieved without relying on the gravity force, the conveyance posture is not restricted to the horizontal direction, and therefore, it becomes possible to improve the design flexibility for designing the structure and arrangements of the apparatus.

While the preferred embodiments of the present invention have been described using specific term, such description is for illustrative purpose only, and it is to be understood that changes and variations may be made without departing from the spirit and scope of the appended claims.

What is claimed is:

1. A paper sheet conveyance apparatus for conveying a paper sheet, picked up from a paper sheet feeding section, through a conveyance path, comprising:

a thickness detecting section to detect a thickness of either a single paper sheet or overlapping paper sheets, which includes a conveyance paper sheet and an overlap paper sheet, currently conveyed in the conveyance path;

a first suction device, disposed at a first position within the conveyance path, to adsorb the conveyance paper sheet currently passing through the first suction device;

a second suction device, disposed at a second position substantially opposing to the first position within the conveyance path, to adsorb the overlap paper sheet currently passing through the second suction device;

an overlapping conveyance path that is branched from the conveyance path; and a control section to conduct controlling operations in such a manner that, when the overlapping paper sheets are conveyed into the conveyance path from the paper sheet feeding section, the first suction device and the second suction device are activated to separate the conveyance paper sheet from the overlap paper sheet, so as to introduce the conveyance paper sheet and the overlap paper sheet into the conveyance path and the overlapping conveyance path, respectively;

wherein the control section activates the second suction device, when an overlapping conveyance of the overlapping paper sheets is detected, based on the thickness detected by the thickness detecting section.

2. The paper sheet conveyance apparatus of claim 1, wherein each of the first suction device and the second suction device includes a plurality of fans.

3. The paper sheet conveyance apparatus of claim 1, wherein the control section sets a wind flow amount of the second suction device at a value 1.2 to 2 times that of the first suction device.

4. The paper sheet conveyance apparatus of claim 1, wherein the control section controls a wind flow amount of the first suction device, based on the thickness of the single paper sheet or the conveyance paper sheet, currently conveyed in the conveyance path.

5. The paper sheet conveyance apparatus of claim 4, wherein the control section sets a first wind flow amount of the first suction device at a value in a range of 0.3-0.9 $m^3$/minute, when conveying the single paper sheet or the conveyance paper sheet, a thickness of which is smaller than 0.15 mm and equal to or greater than 0.08 mm.

6. The paper sheet conveyance apparatus of claim 5, wherein the control section sets a second wind flow amount of the first suction device at a value 1.5 to 2 times the first wind flow amount, when conveying the single paper sheet or the conveyance paper sheet, a thickness of which is equal to or greater than 0.15 mm; and wherein the control section sets a third wind flow amount of the first suction device at a value 0.6 to 0.8 times the first wind flow amount, when conveying the single paper sheet or the conveyance paper sheet, a thickness of which is smaller than 0.08 mm.

7. The paper sheet conveyance apparatus of claim 1, wherein the control section controls a wind flow amount of the first suction device, based on a basis weight of the single paper sheet or the conveyance paper sheet, currently conveyed in the conveyance path.

8. The paper sheet conveyance apparatus of claim 7, wherein the control section sets a first wind flow amount of the first suction device at a value in a range of 0.3-0.9 $m^3$/minute, when conveying the single paper sheet or the conveyance paper sheet, a basis weight of which is in a range of 60-105 gram.

9. The paper sheet conveyance apparatus of claim 8, wherein the control section sets a second wind flow amount of the first suction device at a value 0.6 to 0.8 times the first wind flow amount, when conveying the single paper sheet or the conveyance paper sheet, a basis weight of which is equal to or smaller than 59 gram; and wherein the control section sets a third wind flow amount of the first suction device at a value 1.5 to 1.8 times the first wind flow amount, when conveying the single paper sheet or the conveyance paper sheet, a basis weight of which is in a range of 106-210 gram; and wherein the control section sets a fourth wind flow amount of the first suction device at a value 1.9 to 2.0 times the first wind flow amount, when conveying the single paper sheet or the conveyance paper sheet, a basis weight of which is equal to or greater than 211 gram.

10. The paper sheet conveyance apparatus of claim 1, wherein the control section conducts controlling operations in such a manner that the second suction device is activated, at a time when the conveyance paper sheet closes all over the first suction device, and a leading edge of the overlap paper sheet passes through a center of the second suction device.

11. The paper sheet conveyance apparatus of claim 1, further comprising:

a stacking box to stack the overlap paper sheet in it;

wherein the control section conducts controlling operations in such a manner that the overlap paper sheet is stacked onto the stacking box.

12. A paper sheet conveyance apparatus for conveying a paper sheet, picked up from a paper sheet feeding section, through a conveyance path, comprising:

a first suction device, disposed at a first position within the conveyance path, to adsorb the conveyance paper sheet currently passing through the first suction device;

a second suction device, disposed at a second position substantially opposing to the first position within the conveyance path, to adsorb the overlap paper sheet currently passing through the second suction device;

a reuse conveyance path that is branched from the conveyance path to convey the overlap paper sheet, separated from the conveyance paper sheet, so as to reuse the overlap paper sheet; and a control section to conduct controlling operations in such a manner that, when overlapping paper sheets, which includes a conveyance paper sheet and an overlap paper sheet, are conveyed into the conveyance path from the paper sheet feeding section, the first suction device and the second suction device are activated to separate the conveyance paper sheet from the overlap paper sheet, so as to introduce the conveyance paper sheet and the overlap paper sheet into the conveyance path and the reuse conveyance path, respectively;

wherein the control section controls a wind flow amount of the first suction device, based on a basis weight of the single paper sheet or the conveyance paper sheet, currently conveyed in the conveyance path.

13. The paper sheet conveyance apparatus of claim 12, wherein each of the first suction device and the second suction device includes a plurality of fans.

14. The paper sheet conveyance apparatus of claim 12, further comprising a thickness detecting section to detect a thickness of either a single paper sheet or the overlapping paper sheets, which includes the conveyance paper sheet and the overlap paper sheet, currently conveyed in the conveyance path.

15. The paper sheet conveyance apparatus of claim 14, wherein the control section activates the second suction device, when an overlapping conveyance of the overlapping paper sheets is detected, based on the thickness detected by the thickness detecting section.

16. The paper sheet conveyance apparatus of claim 14, wherein the control section controls a wind flow amount of the first suction device, based on the thickness of the single paper sheet or the conveyance paper sheet, currently conveyed in the conveyance path.

17. The paper sheet conveyance apparatus of claim 12, wherein the control section conducts controlling operations in such a manner that the second suction device is activated, at a time when the conveyance paper sheet closes all over the first suction device, and a leading edge of the overlap paper sheet passes through a center of the second suction device.

18. An image forming apparatus, comprising:

an image forming section to form an image onto a paper sheet; and a paper sheet conveyance section to convey the paper sheet, picked up from a paper sheet feeding section, to the image forming section through a conveyance path;

wherein the paper sheet conveyance section includes:

a thickness detecting section to detect a thickness of either a single paper sheet or overlapping paper sheets, which includes a conveyance paper sheet and an overlap paper sheet, currently conveyed in the conveyance path;

a first suction device, disposed at a first position within the conveyance path, to adsorb the conveyance paper sheet currently passing through the first suction device;

a second suction device, disposed at a second position substantially opposing to the first position within the conveyance path, to adsorb the overlap paper sheet currently passing through the second suction device;

an overlapping conveyance path that is branched from the conveyance path; and a control section to conduct controlling operations in such a manner that, when the overlapping paper sheets are conveyed into the conveyance path from the paper sheet feeding section, the first suction device and the second suction device are activated to separate the conveyance paper sheet from the overlap paper sheet, so as to introduce the conveyance paper sheet and the overlap paper sheet into the conveyance path and the overlapping conveyance path, respectively;

wherein the control section activates the second suction device, when an overlapping conveyance of the overlapping paper sheets is detected, based on the thickness detected by the thickness detecting section.

19. The image forming apparatus of claim 18, wherein each of the first suction device and the second suction device includes a plurality of fans.

20. The image forming apparatus of claim 18, wherein the control section sets a wind flow amount of the second suction device at a value 1.2 to 2 times that of the first suction device.

21. The image forming apparatus of claim 18, wherein the control section controls a wind flow amount of the first suction device, based on the thickness of the single paper sheet or the conveyance paper sheet, currently conveyed in the conveyance path.

22. The image forming apparatus of claim 18, wherein the control section controls a wind flow amount of the first suction device, based on a basis weight of the single paper sheet or the conveyance paper sheet, currently conveyed in the conveyance path.

23. The image forming apparatus of claim 18, wherein the control section conducts controlling operations in such a manner that the second suction device is activated, at a time when the conveyance paper sheet covers all over the first suction device, and a leading edge of the overlap paper sheet passes through a center of the second suction device.

24. An image forming apparatus, comprising:

an image forming section to form an image onto a paper sheet; and a paper sheet conveyance section to convey the paper sheet, picked up from a paper sheet feeding section, to the image forming section through a conveyance path;

wherein the paper sheet conveyance section includes:

a first suction device, disposed at a first position within the conveyance path, to absorb the conveyance paper sheet currently passing through the first suction device;

a second suction device, disposed at a second position substantially opposing to the first position within the conveyance path, to absorb the overlap paper sheet currently passing through the second suction device;

a reuse conveyance path that is branched from the conveyance path to convey the overlap paper sheet, separated from the conveyance paper sheet, so as to reuse the overlap paper sheet; and a control section to conduct controlling operations in such a manner that, when overlapping paper sheets, which includes a conveyance paper sheet and an overlap paper sheet, are conveyed into the conveyance path from the paper sheet feeding section, the first suction device and the second suction device a re activated to separate the conveyance paper sheet from the overlap paper sheet, so as to introduce the conveyance paper sheet and the overlap paper sheet into the conveyance path and the reuse conveyance path, respectively;

wherein the control section controls a wind flow amount of the first suction device, based on a basis weight of the single paper sheet or the conveyance paper sheet, currently conveyed in the conveyance path.

25. The image forming apparatus of claim 24, wherein each of the first suction device and the second suction device includes a plurality of fans.

26. The paper sheet conveyance apparatus of claim 24, further comprising a thickness detecting section to detect a thickness of either a single paper sheet or the overlapping paper sheets, which includes the conveyance paper sheet and the overlap paper sheet, currently conveyed in the conveyance path.

27. The image forming apparatus of claim 26, wherein the control section activates the second suction device, when an overlapping conveyance of the overlapping paper sheets is detected, based on the thickness detected by the thickness detecting section.

28. The image forming apparatus of claim 26, wherein the control section controls a wind flow amount of the first suction device, based on the thickness of the single paper sheet or the conveyance paper sheet, currently conveyed in the conveyance path.

29. The image forming apparatus of claim 24, wherein the control section conducts controlling operations in such a manner that the second suction device is activated, at a time when the conveyance paper sheet covers all over the first suction device, and a leading edge of the overlap paper sheet passes through a center of the second suction device.

* * * * *